US005107906A

United States Patent [19]

Swenson et al.

[11] Patent Number: 5,107,906

[45] Date of Patent: Apr. 28, 1992

[54] SYSTEM FOR FAST-FILLING COMPRESSED NATURAL GAS POWERED VEHICLES

[76] Inventors: Paul F. Swenson, 20431 Almar, Shaker Heights, Ohio 44122; George H. Eversole, 800 W. Shannon Dr., Bridgeport, W. Va. 26330

[21] Appl. No.: 649,238

[22] Filed: Jan. 29, 1991

Related U.S. Application Data

[63] Continuation of Ser. No. 416,145, Oct. 2, 1989, abandoned.

[51] Int. Cl.[5] ..... F17C 7/04

[52] U.S. Cl. ..... 141/11; 141/4; 141/82; 62/50.2; 62/50.3

[58] Field of Search ..... 141/1, 2, 4, 5, 11, 141/18, 82; 62/50.2, 50.3

[56] References Cited

U.S. PATENT DOCUMENTS

| | | | |
|---|---|---|---|
| 2,443,724 | 6/1948 | Cibulka | 62/50.2 X |
| 2,535,364 | 12/1950 | Lee | 62/7 |
| 2,609,282 | 9/1952 | Haug et al. | 62/50.2 X |
| 2,632,430 | 3/1953 | MacSporran | 62/50.2 X |
| 3,552,134 | 1/1971 | Arenson | 62/50.2 |
| 3,712,073 | 1/1973 | Arenson | 62/50.2 |
| 3,720,057 | 3/1973 | Arenson | 62/50.2 X |
| 3,898,853 | 8/1975 | Iung | 62/50.1 |
| 3,962,882 | 6/1976 | Gee et al. | 62/50.1 |
| 3,986,340 | 10/1976 | Bivins, Jr. | 62/50.2 |
| 4,170,115 | 10/1979 | Ooka et al. | 62/50.2 |
| 4,527,600 | 7/1985 | Fisher et al. | 141/4 |
| 4,966,206 | 10/1990 | Baumann et al. | 141/82 X |
| 4,987,932 | 1/1991 | Pierson | 141/1 |

FOREIGN PATENT DOCUMENTS

| | | | |
|---|---|---|---|
| 2604304 | 8/1977 | Fed. Rep. of Germany | 62/50.3 |
| 7070192 | 4/1982 | Japan | 62/50.3 |
| 8180900 | 10/1983 | Japan | 62/50.3 |
| 9170597 | 9/1984 | Japan | 62/50.2 |
| 0004696 | 1/1985 | Japan | 62/50.2 |

*Primary Examiner*—Henry J. Recla
*Assistant Examiner*—Casey Jacyna
*Attorney, Agent, or Firm*—Pearne, Gordon, McCoy & Granger

[57] ABSTRACT

A method of refueling a road transportation vehicle or the like comprising receiving and storing liquid natural gas in a relatively large supply tank at relatively low temperature and moderate pressure, dispensing the liquid natural gas from the supply tank generally exclusively on demand when a vehicle is present for refueling, delivering the dispensed gas to a high-pressure fuel tank on the vehicle while simultaneously converting it to compressed natural gas vapor at relatively high pressure and moderate temperature through the addition of energy to the gas primarily in thermal form. In one embodiment the pressure of the natural gas is elevated by a mechanical pump while in another embodiment the pressure of the natural gas is raised primarily by the addition of heat.

5 Claims, 4 Drawing Sheets

SYSTEM FOR FAST-FILLING COMPRESSED NATURAL GAS POWERED VEHICLES

This is a continuation of application Ser. No. 416,145, filed Oct. 2, 1989 now abandoned.

BACKGROUND OF THE INVENTION

The invention relates to alternate fuels for the transportation industry and, in particular, relates to a system for utilizing natural gas as a fuel for road vehicles.

Natural gas offers an alternative fuel for road vehicles and is currently used as such on a limited scale. In most instances, in current use, natural gas is carried aboard the vehicle in a high-pressure tank with a working pressure of, for example, 3,000 or 3,600 psi. Conventionally, the vehicle fuel tank is filled from a battery of tanks storing gas at a pressure somewhat higher than the vehicle tank working pressure or is filled over a relatively long period, overnight for example, from a small compressor.

These conventional tank filling systems are not well-suited for use with those large transportation vehicles which must be refueled in a relatively short time, for example, of several minutes to satisfy established operational constraints related to servicing, storage and/or usage procedures. The capital cost of a bank of storage tanks or of a compressor that can deliver flow rates to satisfy a fast-fill requirement can be prohibitive. Further, a refueling depot for mass transit busses, highway trucks, or other high fuel volume applications may exist at a location not served by a natural gas pipeline or by a pipeline of adequate capacity. Liquid natural gas (LNG) offers relatively high energy per unit volume and could be readily employed in a relatively inexpensive refueling facility for fast-filling of large transportation vehicles. However, in some locations LNG cannot be carried on-board in a vehicle fuel tank because of safety regulations.

SUMMARY OF THE INVENTION

The invention provides a system for refueling vehicles with compressed natural gas at high mass-flow rates that utilizes a store of liquid natural gas to avoid the need for expensive compressors or a large bank of compressed natural gas storage tanks. In accordance with the invention, liquid natural gas is converted to compressed natural gas on a demand basis, the conversion being accomplished at the same time the vehicle fuel tank is being filled.

In one disclosed embodiment of the invention, natural gas is stored in a tank in the liquid state at cryogenic temperatures and relatively low pressure. When a vehicle is present to be refueled, liquid natural gas is dispensed from the tank by a pump which increases its pressure above that required in the vehicle fuel tank. The liquid natural gas is caused to pass through a heat exchanger where thermal energy is added to the gas to cause it to change into its vapor state and to raise its temperature into the ambient range. Advantageously, heat for changing the gas from its liquid to its vapor state, besides that absorbed from the environment in an air heated heat exchanger can be derived from combustion of small quantities of the natural gas being processed.

The invention avoids the need for expensive high volumetric capacity compressors or banks of high-pressure storage tanks which would otherwise be required for providing high fill rates for large transportation vehicles.

In a variant of the invention, liquid natural gas is dispensed on demand from a cryogenic low-pressure storage tank cyclically into alternate conversion tanks where heat transforms the gas from its liquid state to a high-pressure gaseous state. Typically, the conversion tanks operate only when there is a demand for a vehicle fuel tank to be filled. The conversion tanks can utilize heat from the environment and/or heat of combustion of a small percentage of the stored gas. In this arrangement, a low-pressure differential pump is used to dispense liquid natural gas from the storage tank to the conversion tanks.

DESCRIPTION OF THE PREFERRED EMBODIMENTS

Figure 1:
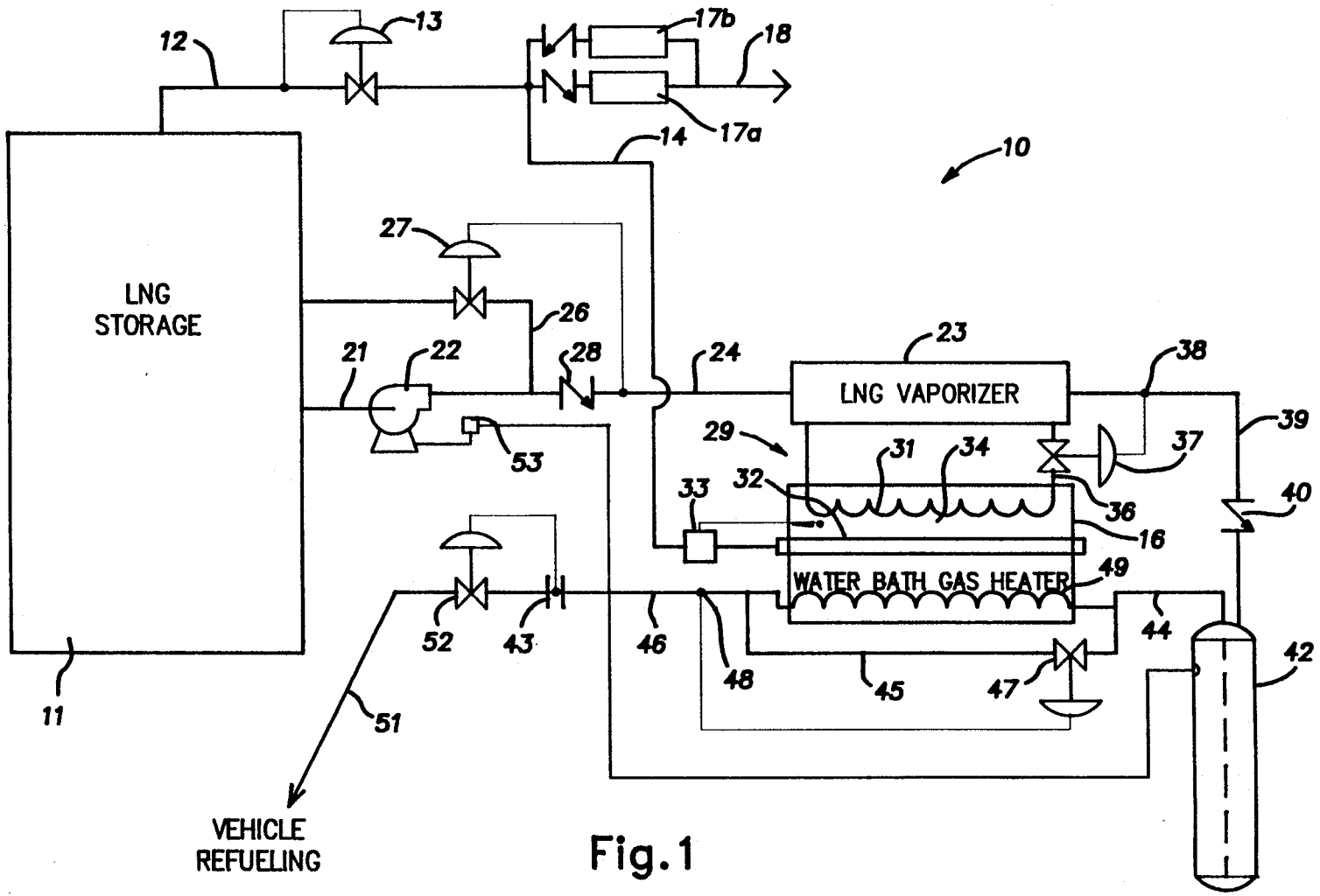
FIG. 1 is a schematic diagram illustrating a first embodiment of the invention.

Referring now to the drawings and in particular to FIG. 1, there is represented a site 10 at which transportation vehicles such as mass-transit busses, school busses, highway trucks or delivery trucks can be refueled with natural gas. A main storage tank 11 of the system or site 10 holds liquid natural gas at cryogenic temperatures, i.e. between approximately −240° F. to −160° F. and relatively low pressure, i.e. from about 30 to 100 psi above atmospheric pressure. Typically, for a bus depot, the tank 11 can have a capacity of 20,000 gallons. The tank 11 can be of known construction and is insulated from the surrounding environment in a manner that allows it to maintain the pressure of its contents within the 30 to 100 psi working range for at least several days. The tank 11 receives liquid natural gas, for example, from a tanker truck or railroad tank car.

The tank 11 is vented by a line 12 that includes a safety pressure relief valve or regulator 13. Natural gas which has boiled off the liquid in the tank 11 is released by the pressure regulating valve 13 and is conducted by a line 14 to a burner of a water bath heater 16 where it can be combusted as discussed below. Excess vaporous fuel boil-off from the vent line 12 can be directed through a meter **17*a* into a utility distribution line 18, if desired. Another meter 17*b* can be provided to supply utility gas to make up any shortfall of boil off required by the heater 16**.

A line 21 conducts liquid natural gas from the store in the tank 11 to the inlet of a high-pressure pump 22. The mechanical pump which may be of the gear-type raises the pressure of the liquid natural gas to a pressure of 3,100 or 3,700 psi, for example, so that it is somewhat above the maximum operating pressure at which a vehicle fuel tank is operated, for example 3,000 or 3,600 psi. The pump 22 delivers high-pressure liquid natural gas to a heat exchanger 23 through a line 24. A branch line 26 connected to the pump discharge line 24 allows excess pressure to be relieved back to the tank 11 under the control of a pressure regulator 27. A check valve 28 is provided in the line 24 between the branch line 27 and heat exchanger 23. The lines 21, 24 and 26 and components 22, 27 and 28 carrying liquid natural gas are thermally insulated from the environment. The energy required by the pump 22 to raise the pressure of the liquid natural gas to these pressures is a small percentage of what would be required if the natural gas was in its vapor state and was compressed to raise its pressure by the same differential.

The schematically illustrated heat exchanger 23 is of the shell and tube type, of generally conventional construction, arranged to carry the natural gas in the tubes portion. A propane circuit indicated generally at 29 has propane circulating through the shell section of the heat exchanger 23. The propane circuit 29 includes a propane heating coil 31 which is immersed in the tank of the water bath heater 16. An immersion heater or burner schematically illustrated at 32 combusts the vaporous natural gas boil-off coming from the tank 11 through the line 14 to heat the water in the heater 16. The burner 32 consists of a flame holder surface at one end of a tube containing the products of combustion submerged in water contained in the tank of the heater 16. A thermostatic controller 33 controls the amount of gas being burned by the burner 32 to maintain the water bath 34 of the heater 16 at a desired temperature of, for example, 68° F. The propane circuit 29, in the illustrated example, operates by natural convection with warm propane gas being produced in the heating coil 31 and rising to the shell of the heat exchanger 23 where it exchanges heat with the liquid natural gas in the tubes being supplied by the pump 22. The propane condenses in the heat exchanger shell and returns to the water bath coil 31 through a line 36 and an associated temperature controller 37. The controller 37 has a thermostatic element 38 sensing the temperature of natural gas leaving the heat exchanger 23 and regulates the amount of flow through the propane heating circuit 29 accordingly. It is the objective of the controller 38 to maintain LNG at a supercritical state above the saturated vapor dome within the heat exchanger 23, so that most of the superheating of the methane gas occurs in circuit 49. As an alternative to propane, other low temperature heat transfer fluids can be employed, such as carbon dioxide.

Natural gas in a cryogenic liquid state is delivered at high pressure to the heat exchanger 23. This natural gas is changed to a vapor state by absorption of heat from the circulating propane in the heat exchanger 23. Natural gas vapor from the heat exchanger is conducted from the exchanger 23 through a line 39 and a check valve 40 to a surge tank 42. The natural gas at this point will be at a supercritical state above the saturated vapor dome for pure methane, e.g. −60° F. to −100° F. The surge tank 42 serves to stabilize the pressure of the natural gas to achieve improved final delivery control to a vehicle. From the tank 42 natural gas is delivered to a volumetric meter 43 through a parallel pair of lines 44–46. A temperature control valve 47 in the line 45, having a thermostatic control element 48 in the line 46 before the meter, assures that the temperature of, for example, 67° F. of gas combined from both circuits is delivered to the meter 43 is at a proper desired temperature for metering. This is accomplished by the valve 47 restricting the volume of flow through the line 45 in proportion to flow through a heating coil 49 in the water bath heater 16 that is in a parallel flow circuit with the line 45. Gas is delivered to a vehicle through a line 51. A flow control valve 52 in the line 51 limits the rate of flow delivered through the line 51.

The pump 22 is on when a vehicle is present for refueling. The pump is off otherwise. If desired, a controller 53 can be provided to sense pressure in the tank 42 and modulate operation of the pump 22 for example by speed. When fuel vapor is delivered through the line 51 and pressure in the tank 42 tends to be lowered, the pump 22 is operated accordingly to dispense liquid natural gas from the storage tank 11 into the heat exchanger 23 to make up for any volume of natural gas vapor being dispensed on demand. In general, the surge tank 42 can have a volume that is relatively small and, ordinarily, is a fraction, for example 1/5, the volume of a typical fuel tank capacity on a large vehicle being refueled at the site 10.

Where the boil-off of the gas in the storage tank 11 is not sufficient, additional heat energy can be provided by diverting a small quantity of the natural gas vapor produced by the heat exchanger 16, through appropriate pressure-reducing control circuitry (not shown). It is preferable in most cases to provide any additional fuel from line 18, to avoid the complication of pressure reduction. In general, approximately 1 to 1½% of the gas stored in the tank 11 is necessary for converting it from its cryogenic liquid state to a vapor state at high pressure and moderate temperature.

Figure 2:
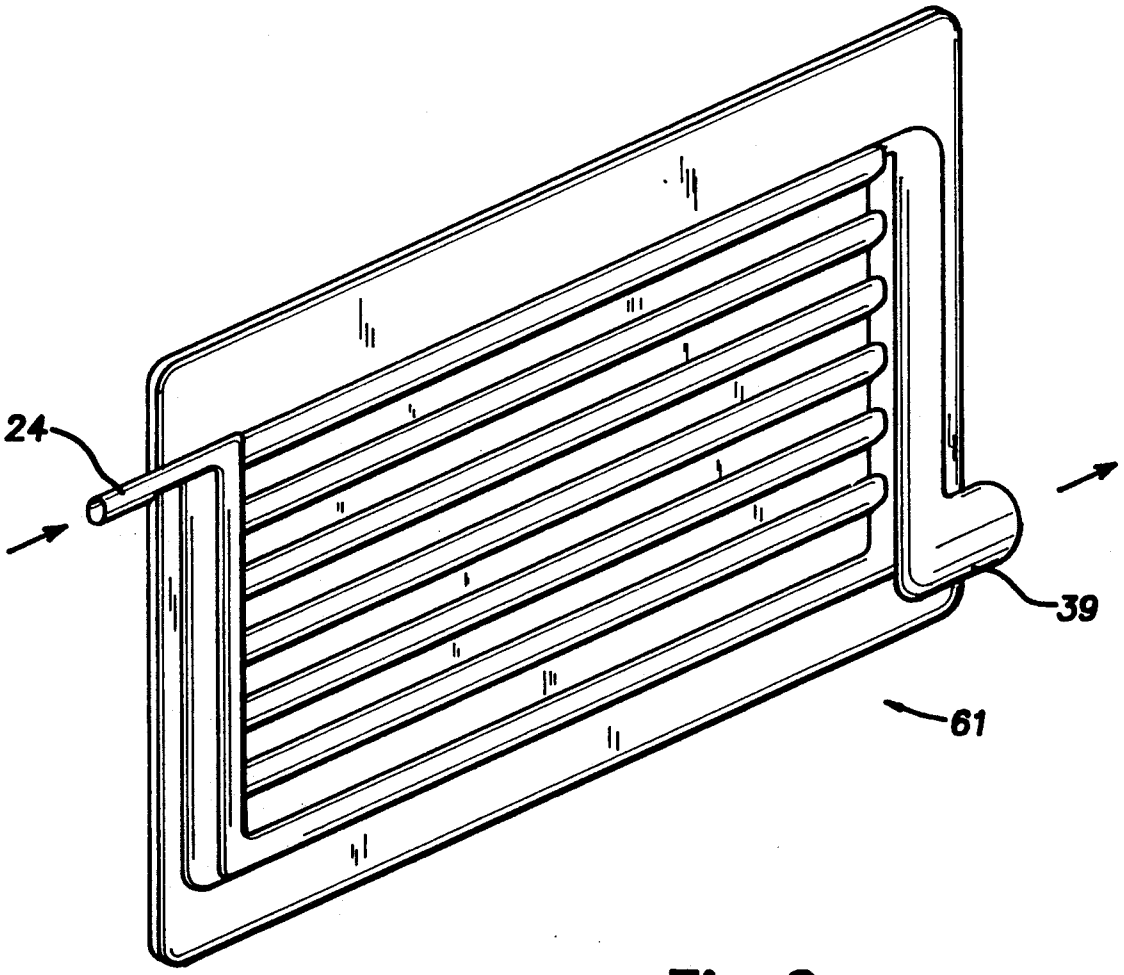
FIG. 2 is an illustration of an alternative heating system to that shown in FIG. 1.

As a variant to the system disclosed in FIG. 1, FIG. 2 illustrates a substitute heating means in the form of a plate-type heat exchanger 61. The heat exchanger 61 can be substituted for the exchanger 23, being connected between the lines 24 and 39. The heat exchanger 61 is of a generally conventional-type construction used to commercially convert cryogenic liquids to gases by using atmospheric air as a heat source. When the plate heat exchanger 61 is used, the water bath heater 16 can be retained, without the propane heat exchange circuit 29, to supplement the heating provided by the plate heat exchanger 61 and maintain precise temperature control.

Figure 3:
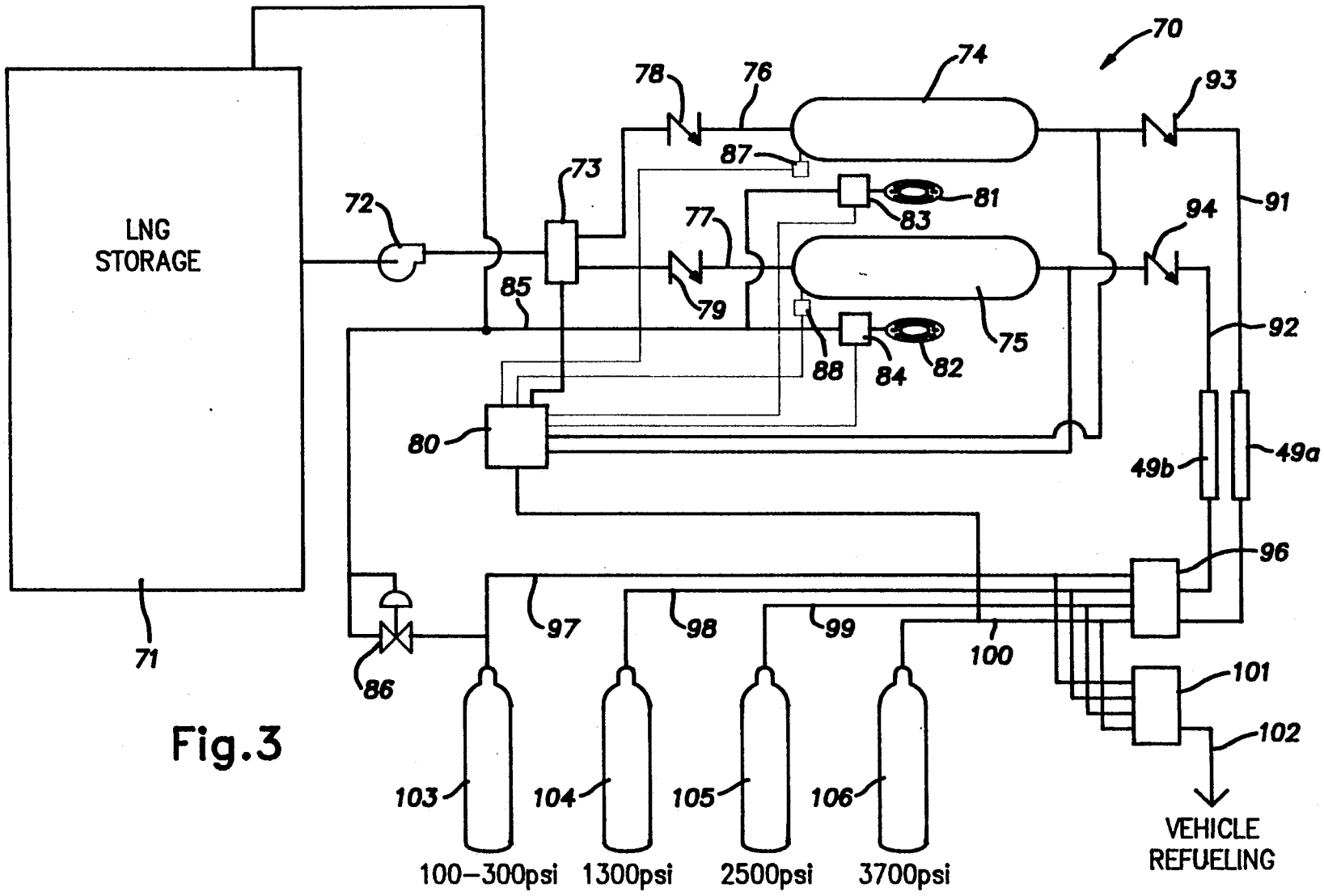
FIG. 3 is a schematic diagram of another embodiment of the present invention in which liquid natural gas is converted to its vapor state in alternate conversion vessels.

Referring now to FIG. 3, there is shown another system for converting liquid natural gas to high-pressure natural gas vapor primarily by the addition of heat energy. The system or site 70 includes a cryogenic storage tank 71 like the tank 11 of FIG. 1. A medium pressure differential transfer pump 72 moves liquid natural gas from the storage tank 71 to a control valve 73 and one of two alternate conversion tanks 74, 75. The pump 72 and associated lines carrying liquid natural gas are thermally insulated from the environment. The pressure in the storage tank 71 is in the order of 100 to 300 psi above atmosphere, for example. The circulating pump 72 is arranged to raise the pressure of the liquid natural gas to 350 psi, for example, so that this pressure is higher than that of the lowest pressure tank 103 in a cascade set of tanks described below. The pump 72 delivers liquid natural gas through the valve 73 and alternate lines 76, 77 having check valves 78, 79.

Each of the tanks 74, 75 is a closed vessel and has associated with it an individual heater 81, 82 that burns natural gas vapor boil-off from the tank 71 from a line 85 under the control of burner valves 83, 84. Any shortfall of natural gas from the boil-off to operate the burners 81, 82 can be made up from a low pressure source such as a utility or from a low-pressure tank 103 described below and fitted with a suitable pressure regulator 86 connected to the line 85.

Depending on the position of the valve 73, liquid natural gas is delivered to one or the other of the tanks 74, 75 until it is filled to the desired level, but not completely full of liquid. Sensors 87, 88 measure the weight of a respective tank 74, 75 and its contents and indicate the same to an automatic controller 80. Once filled to desired level, a tank 74 or 75 is then heated by firing its associated burner 81 or 82 through operation of the controller 80. As the tank 74 or 75 is heated, the liquid natural gas contained in it absorbs heat and is converted to high-pressure supercritical vapor in a gradual staged process coinciding with demand normally as a vehicle is being refueled. In the illustrated case, the system is arranged to produce a maximum working pressure of 3,700 psi. Natural gas at this high pressure is conducted from a tank 74 or 75 through an associated line 91 or 92 and check valves 93, 94 to a set of priority panel valves 96 of generally known construction. Heat exchangers schematically shown at 49*a*, 49*b* in the lines 91, 92 and like the heating coil 49 in FIG. 1, temper the gas to a desired temperature. The priority panel 96 has a plurality of lines 97–100 each individually connecting it to a tank of a series or cascade of tanks 103–106. The lines 97–100 are also individually connected to a set of sequence panel valves 101 also generally known in the art. The sequence panel 101 directs pressurized natural gas vapor to a vehicle to be refueled through a line 102.

In operation, the line 102 is coupled to the fuel tank of the vehicle to be refueled. The sequence panel 101 begins the refueling process by communicating the line 102 with the lowest pressure tank 103 in the cascade. When flow from the tank 103 ceases indicating that the vehicle's fuel tank is refilled to the pressure in this tank 103, the sequence panel connects the line 102 to the next highest pressure tank 104 in the cascade. When flow ceases from that tank to the vehicle, the sequence panel shifts to the line 99 connecting the next highest pressure tank 105 to the vehicle refueling line 102. This process is repeated as the pressure in the vehicle fuel tank increases until finally the highest pressure tank 106 delivers gaseous natural gas at 3,700 psi. A valve (not shown) associated with the delivery line 102 ensures that the vehicle fuel tank is not filled to a pressure exceeding its rated working pressure of, for example, 3,600 to 3,000 psi.

The controller 80 operates the valve 73 to feed liquid natural gas into one or the other of the conversion tanks 74, 75. Once a tank 74 or 75 is filled to a desired level with liquid, a condition sensed by a sensor of the weight of the tank and its contents and monitored by the controller 80, the controller closes the valve 73 supplying liquid natural gas to that tank and initiates operation of the associated burner 81 or 82 to raise and maintain the pressure in this tank containing liquid and vapor to 3,700 psi. A suitable pressure sensor (not shown) associated with each tank 74, 75 signals the controller 80 of the pressure existing in its associated tank. As previously mentioned, the cold low-pressure liquid natural gas is converted in the tank to high-pressure supercritical natural gas vapor at a state above the vapor dome by the addition of heat from this burner. This supercritical vapor is tempered in a heat exchanger 49*a* or 49*b* on its path to the priority panel valve 96.

When pressure in a line 91 or 92 connecting one of the conversion tanks being depleted of vapor to the priority panel 96 drops below 3,700 psi, as a result of the tank 74 or 75 being depleted of liquid, the priority panel connects the line to the next lowest pressure tank 105 until pressure in the conversion tank drops below the nominal operating pressure of such tank. At this time, the priority panel shifts again and connects the line 91 or 92 to the next lowest tank 104 and this process repeats until pressure in the last heated conversion tank drops to the working pressure of the lowest pressure rated tank 103.

While one of the conversion tanks 74 is being heated and is discharging natural gas vapor, the other tank, under the direction of the controller 80 can be filled with liquid natural gas for conversion into natural gas vapor upon operation of the associated burner 81 or 82. Operation of this subsequent burner can be initiated by the controller 80 before the discharging tank is completely depleted of liquid so that this other tank is standing by with high-pressure vapor. This alternate tank scheduling method thus provides an uninterupted supply of high-pressure vapor to the priority panel 96 as the pressurization cycle in the preceding tank enters the pressure reduction cascade cycle.

Suitable pressure reducing valves (not shown) can be connected from each pressure storage tank 106, 105 etc. to the next lowest pressure storage tank in the cascade to maintain pressure at their desired settings. The total volume of the cascade tanks 103–106 can be limited to less than that of the capacity of a typical fuel tank of a vehicle to be refueled at the site 70, since they are replenished from 74 or 75 continuously. Where the low pressure tank 103 operates at a pressure too low for refilling a vehicle fuel tank, its contents can be used with conventional pressure reduction, as mentioned, for fueling the burners 82, 83 or can be fed through a meter to a utility line.

Figure 4:
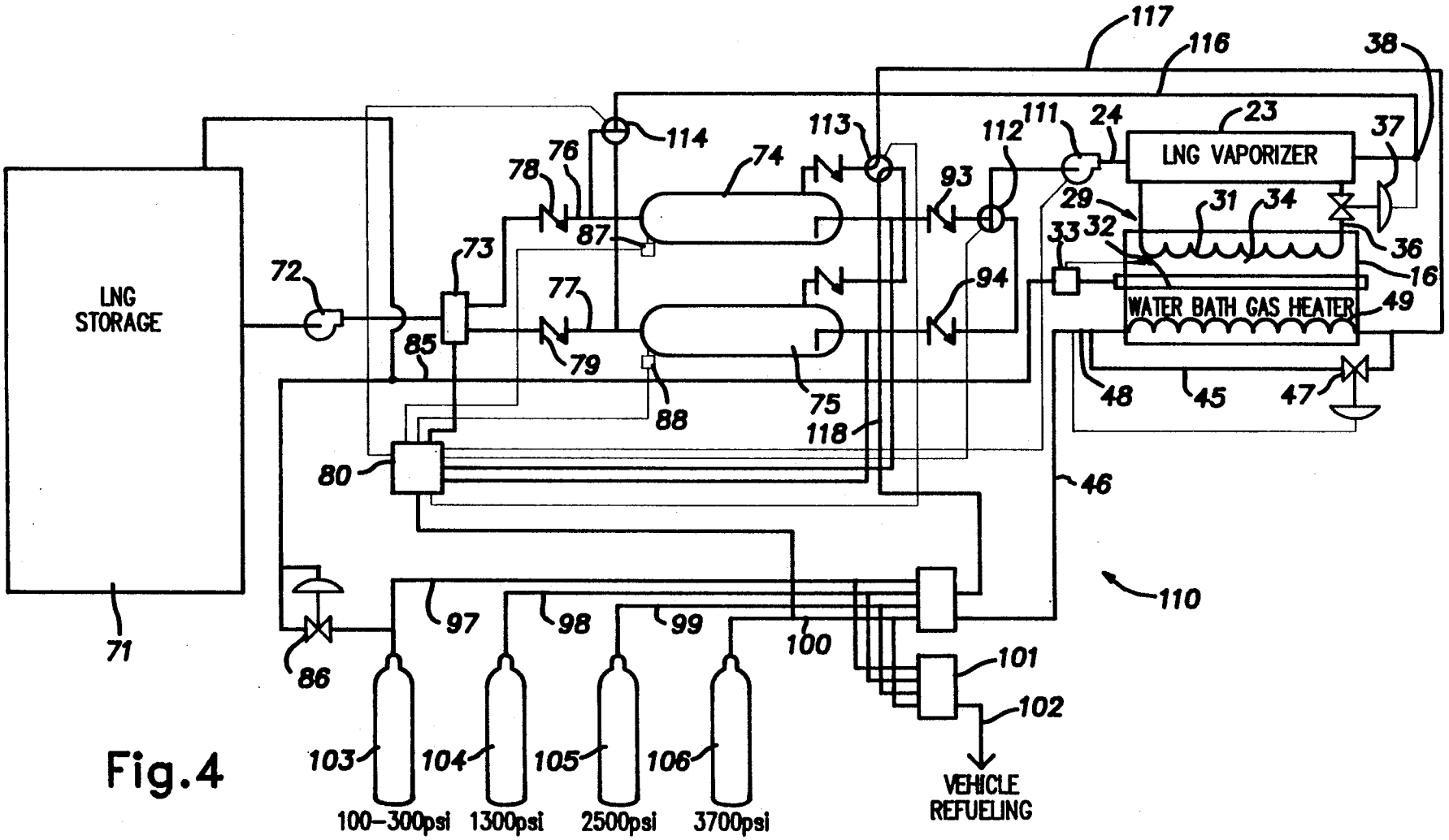
FIG. 4 is a schematic diagram of still another embodiment of the invention combining features of the systems shown in FIGS. 1 and 3.

FIG. 4 illustrates another variant of the invention wherein features of the systems 10 and 70 of FIGS. 1 and 3, respectively, are combined in a system 110. This system 110 differs from the system 70 primarily in that liquid natural gas processed in alternate tanks or vessels 74, 75 is converted to vapor at a common heat exchanger vessel 23 separate from the tanks. In the diagram of FIG. 4, components having essentially the same function as in the previously described systems 10 and 70 are identified by the same numerals.

The system 110 converts relatively low pressure liquid natural gas stored in the tank 71 to high-pressure vapor largely by the addition of thermal energy. In alternate cycles, liquid natural gas is conveyed from the processing tanks 74, 75 by a circulating pump 111, without significant mechanical pressurization, to the heat exchanger 23. In the heat exchanger 23, the liquid natural gas is changed into a vapor and is caused to increase its volume as it is converted to a vapor. This results in an increase in the pressure within the confinement defined by the components 74/74, 112-111-24-23-38-116-114 ultimately resulting in a pressure of, for example, 3,700 psi. The controller 80, operating a set of synchronized valves 112 and 114 determines which of the tanks 74, 75 is actively connected to the heat exchanger 23 while the other tank 74 or 75 is isolated from these vessels. When a tank 74 or 75 containing liquid natural gas is connected for free fluid communication to the heat exchanger 23 by the valves 112, 114 the pump 111 is operated or modulated by the controller 80 to deliver a sufficient quantity of liquid natural gas to the heat exchanger to maintain the desired working pressure in such tank. The circuitry includes a return line 116 for vapor exiting the heat exchanger 23 for delivery through the valve 114 to either one of the tanks 74 or 75. Pressure is maintained in an active one of the tanks 74 or 75 by appropriately operating the pump 111 to draw sufficient quantities of liquid natural gas from this active tank and circulate it into the heat exchanger 23. A tank 74 or 75 supplies high pressure vapor to the priority panel valve 96, the cascade tanks 103–106, and ultimately to a vehicle through the valve 113, a line 117, the water bath heater coil 49 where the cold vapor is tempered, i.e. armed to a desired temperature, and the line 46. While one tank 74 or 75 is being depleted of liquid natural gas by vaporization in the heat exchanger 23 and delivery to the priority panel valve 96, the other tank may be refilled with a new charge of liquid natural gas by operation of the valve 73 under control of the controller 80.

When a sensor 87 or 88 indicates that a tank 74 or 75 is approaching depletion of liquid natural gas, the controller 80 switches the roles of the tanks 74 and 75. The synchronized valves 112–114 are shifted to their alternate positions. Liquid natural gas in the previously refilled tank is now circulated by the pump 111 through the heat exchanger 23 to meet the demand for high-pressure vapor. A line 118 is connected to the liquid depleted tank 74 or 75 by the 4-way valve 113 to the priority panel valve 96 through which pressure in such liquid depleted tank is reduced from 3,700 psi in the cascade ultimately to 100 to 300 psi as described above in connection with FIG. 3.

In the heat exchangers 23, 61 and in the tanks 74, 75 and associated circuitry, heating is limited by the respective controllers 33, 80 so that largely a phase change occurs in these vessels and there is no significant superheating of the vapor and the temperature at which these vessels operate is relatively constant at approximately −60° F. to −160° F., for example. In this way, thermal cycling stresses in these vessels are minimized.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

We claim:

1. A method of refueling a road transportation vehicle comprising receiving and storing liquid natural gas at a site in a relatively large supply tank at relatively low cryogenic temperature and moderate pressure, dispensing the liquid natural gas from the supply tank generally exclusively on demand when a vehicle is present for refueling, converting the dispensed gas to compressed natural gas vapor at relatively high pressure of several thousand psi and moderate near ambient temperature through the addition of energy to the gas primarily in thermal form while simultaneously delivering the gas in vapor form to a high-pressure fuel tank on the vehicle whereby the need for large horsepower vapor compressor capacity and/or large volume high-pressure storage capacity at the site is avoided, the liquid natural gas being converted in one zone to its supercritical state by the addition of heat, the natural gas being raised to a control temperature at or near ambient temperature in another zone by the controlled addition of heat by measuring the temperature of the gas after it is heated in said another zone.

2. A method as set forth in claim 1, wherein mechanical energy is used to pressurize the liquid natural gas to a high pressure and thermal energy is used to convert the high-pressure liquid natural gas to a vaporous state.

3. A method as set forth in claim 1, wherein thermal energy is derived from combustion of gas stored in the tank.

4. A method as set forth in claim 3, wherein boil-off vapor from the storage tank is used as fuel for combustion for producing thermal energy.

5. A method as set forth in claim 1, wherein boil-off vapor from the storage tank is supplied to a utility line through a meter.

* * * * *